US006489569B1

(12) United States Patent
Thomson

(10) Patent No.: US 6,489,569 B1
(45) Date of Patent: Dec. 3, 2002

(54) INSULATOR RETAINER

(75) Inventor: Bradley John Thomson, Hamilton (NZ)

(73) Assignee: Gallagher Group, Ltd., Hamilton (NZ)

( * ) Notice: Subject to any disclaimer, the term of this patent is extended or adjusted under 35 U.S.C. 154(b) by 0 days.

(21) Appl. No.: 09/914,713

(22) PCT Filed: Apr. 20, 2000

(86) PCT No.: PCT/NZ00/00060

§ 371 (c)(1),
(2), (4) Date: Aug. 31, 2001

(87) PCT Pub. No.: WO00/67563

PCT Pub. Date: Nov. 16, 2000

(30) Foreign Application Priority Data

May 7, 1999 (NZ) ..... 335672

(51) Int. Cl.[7] ..... H01B 17/24

(52) U.S. Cl. ..... 174/154; 174/158 F; 174/163 F; 248/71; 248/547; 248/548; 411/377; 411/441; 411/970

(58) Field of Search ..... 174/138 R, 154, 174/158 F, 159, 161 F, 163 F, 163 R, 165, 171; 248/71, 74.5, 547, 548; 411/377, 441, 512, 32, 33, 970, 999

(56) References Cited

U.S. PATENT DOCUMENTS

| | | | | | |
|---|---|---|---|---|---|
| 2,255,649 | A | * | 9/1941 | Burke | 411/176 |
| 2,378,257 | A | * | 6/1945 | Tinnerman | 411/174 |
| 3,913,888 | A | * | 10/1975 | Maranell | 174/158 F |
| 4,127,250 | A | * | 11/1978 | Swick | 174/159 |
| 4,263,477 | A | | 4/1981 | Wilson | |
| 4,582,288 | A | * | 4/1986 | Ruehl | 174/159 |
| 4,680,428 | A | * | 7/1987 | Wilson, Jr. | 174/158 F |
| D300,423 | S | * | 3/1989 | Reeves | 174/163 F |
| 4,828,444 | A | * | 5/1989 | Oshida | 411/437 |
| 4,982,932 | A | * | 1/1991 | Baker | 174/154 |
| 5,085,409 | A | * | 2/1992 | Teixeira | 174/158 F |
| 5,411,228 | A | | 5/1995 | Morawa et al. | |
| 5,739,474 | A | | 4/1998 | Bradley | |
| 6,190,372 | B1 | * | 2/2001 | Racz | 128/912 |
| 6,378,813 | B1 | * | 4/2002 | Gretz | 248/68.1 |

FOREIGN PATENT DOCUMENTS

| | | |
|---|---|---|
| DE | 1190162 A | 4/1965 |
| DE | 2242147 A | 3/1974 |
| EP | 860837 A2 | 8/1998 |
| GB | 574111 B | 12/1945 |
| SU | 1385149 A | 3/1988 |

* cited by examiner

*Primary Examiner*—Dean A. Reichard
*Assistant Examiner*—Adolfo Nino
(74) *Attorney, Agent, or Firm*—Greer, Burns & Crain, Ltd.

(57) ABSTRACT

An insulator capable of supporting the conductor of an electric fence including at least one retaining portion capable of retaining at least one fixing element to the insulator prior to the insulator being fixed to a support structure with the fixing element.

7 Claims, 2 Drawing Sheets

INSULATOR RETAINER

BACKGROUND ART

Presently insulators are used to support the conducting material of electric fences. These insulators are generally secured to fence posts via screws, staples or other fixing elements.

To secure insulators to posts generally requires a farmer to hold both the insulator and the fixing element. Understandably affixing the insulator to the support structures can be a fiddly affair. It is very easy to drop the fixing element while obtaining the device to engage the fixing element, for example a hammer, or a screwdriver. This results in either wasting resources by leaving the fixing element on the ground, or alternatively having to reach down and scramble around trying to find it on the ground, which can be difficult when working over rough ground.

Another drawback is that currently the fixing element must be directly held onto, to avoid it falling out. This increases the chance of hitting your thumb or fingers during the process of fixing the insulator to the supporting structure, for example a fence post.

Consequently, fixing insulators to supporting structures can be frustrating, and either a time consuming exercise, or wasteful of resources. These problems make the present system of affixing insulators an inefficient process, demanding more time and resources than are necessary.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided an insulator capable of supporting the conducting material of an electric fence, characterised in that the insulator includes at least one retaining-portion capable of retaining at least one fixing element to the insulator prior to the insulator being affixed to a support structure with the fixing element.

According to a further aspect of the present invention there is provided a method of affixing to a support structure an insulator capable of supporting the conducting material of an electric fence characterised by the steps of (a) placing a fixing element in at least one retaining-portion in the insulator capable of retaining the fixing element, and (b) fixing the insulator with the fixing element to the support structure.

It is envisaged that the retaining-portion may have a variety of different shapes and configurations without departing from the scope of the present invention.

There are provided standard apertures in insulators through which fixing elements pass to secure the insulators to the support.

In general, the retaining-portion may be in the form of an opening of a configuration capable of holding a fixing element to a greater degree than would normally be provided by the standard apertures.

In some embodiments the opening of the retaining-portion may include a number of projections which project into the opening. The projections may be made from a material which is at least partially resilient.

In preferred embodiments, inserting the fixing element into opening causes distortion of the projections, which are then able to frictionally engage the fixing element so as to retain it within the opening.

In preferred embodiments, the retaining-portion may be in the form of an opening which includes a number of flaps which project therein. The flaps which project therein may also be made from a partially resilient material, for example nylon or plastic.

In some other embodiments the retaining-portion may be in the form of an opening of a size and configuration which enables it to frictionally engage the fixing element so as to retain it within the opening. Preferably the opening in such embodiments may be made surrounded by at least partially resilient material.

In one embodiment the opening may be of a narrower girth than the rest of the aperture through which the fixing element passes.

Alternatively the whole of the opening may be of a smaller size than the cross-section of the fixing means. It is the resilient material around the opening that 'gives' to hold the fixing element.

The retaining-portion may be capable of holding the fixing elements in the orientation required to enable the element to affix the insulator to the support member/structure.

Some embodiments may just hold the fixing element before the user places it into the aperture for fixing. However, these embodiments have less advantages than the previous one.

It is envisaged that the fixing element may be any device capable of affixing an insulator to a support member/structure.

It is envisaged the fixing elements may include nails, screws and staples. However, it should be appreciated that this list is not intended to be limiting.

In general, the support member may be a fence post, or the outer surface of a building or other structure. Again, this should not be seen as necessarily limiting the scope of the present invention.

An advantage of the present invention may have over existing insulators, is that the process of affixing insulators to support structures is facilitated rendering it less fiddly to undertake. Thus, the present invention also enables less time to be spent on the exercise, and less resources lost, creating a more efficient method of affixing insulators to their supporting structures.

Also, by removing the requirement to hold the fixing element there is less pain and frustration occuring due to injuries.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1A:
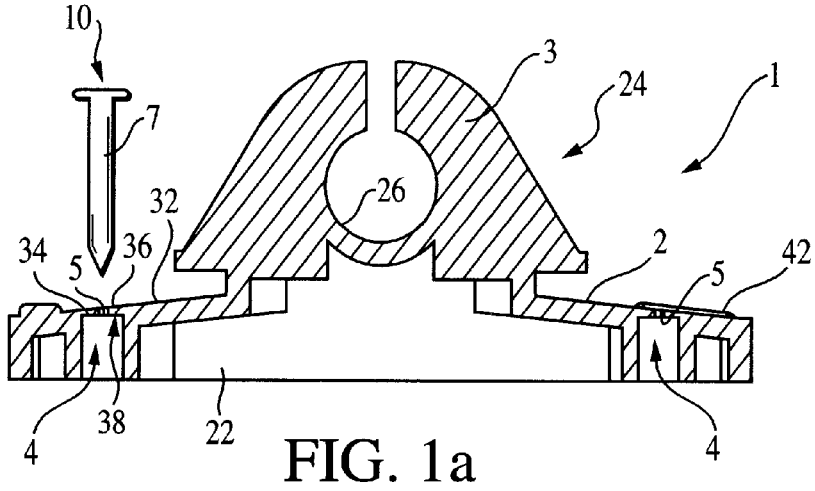
FIG. 1 shows a side and plan view of one preferred embodiment of the present invention.
Figure 1B:
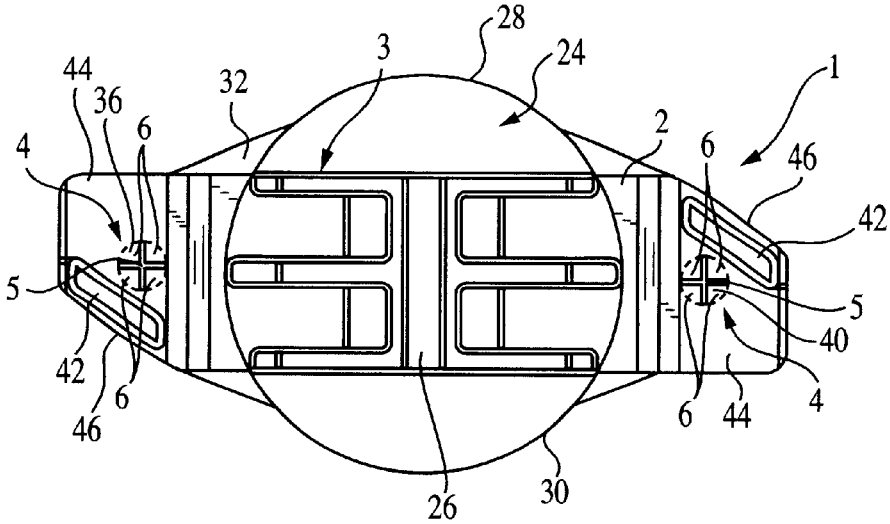

With respect to FIG. 1 there is illustrated in FIGS. 1*a*) and 1*b*) a side and plan view respectively of one preferred embodiment of insulator generally indicated by arrow 1.

The insulator 1 consists of a main body 2 and an electric fence wire support 3.

The main body 2 of the insulator 1 has two retaining-portions 4 consisting of an opening 5 which has four flaps 6 extending therein which have been demarcated by a dotted outline for ease of visual perception only.

In use a fixing element in the form of a nail 7 may be inserted into the retaining-portion 4 in the direction indicated by arrow 10.

Figure 1C:
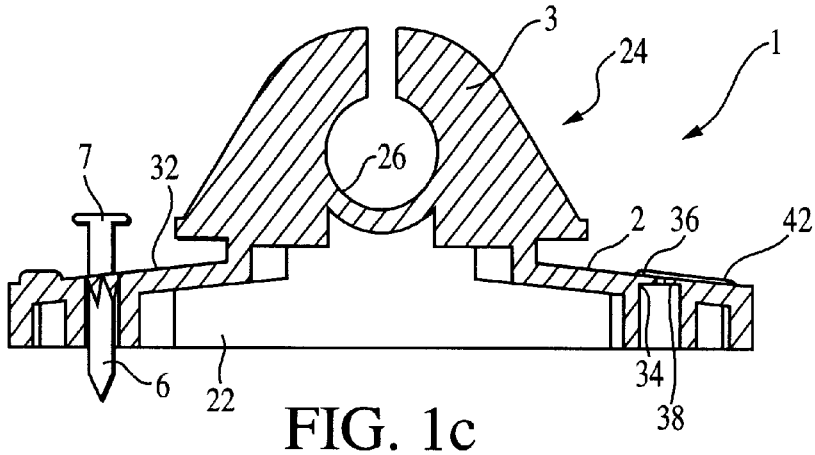

Inserting the nail 7 into the retaining-portion 4 causes the flaps 6 to deform to accommodate the girth of the nail 7 as is shown in FIG. 1*c*). By this means the flaps 6 are able to, once the nail 7 has been inserted, frictionally engage the outer surface of the nail 7 to prevent it from dislodging from the insulator 1.

Figure 2A:
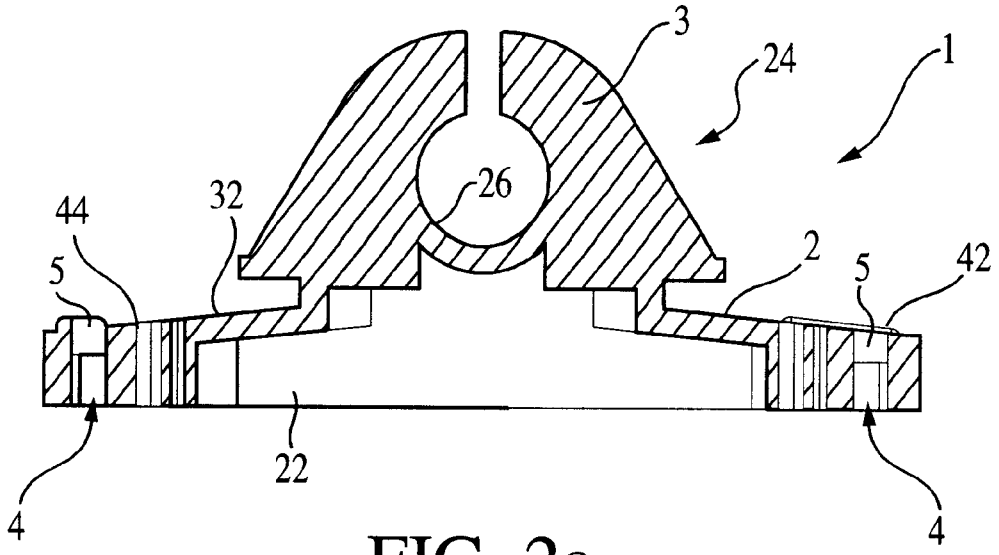
FIG. 2 is a side and plan view of another embodiment of the present invention.
Figure 2B:
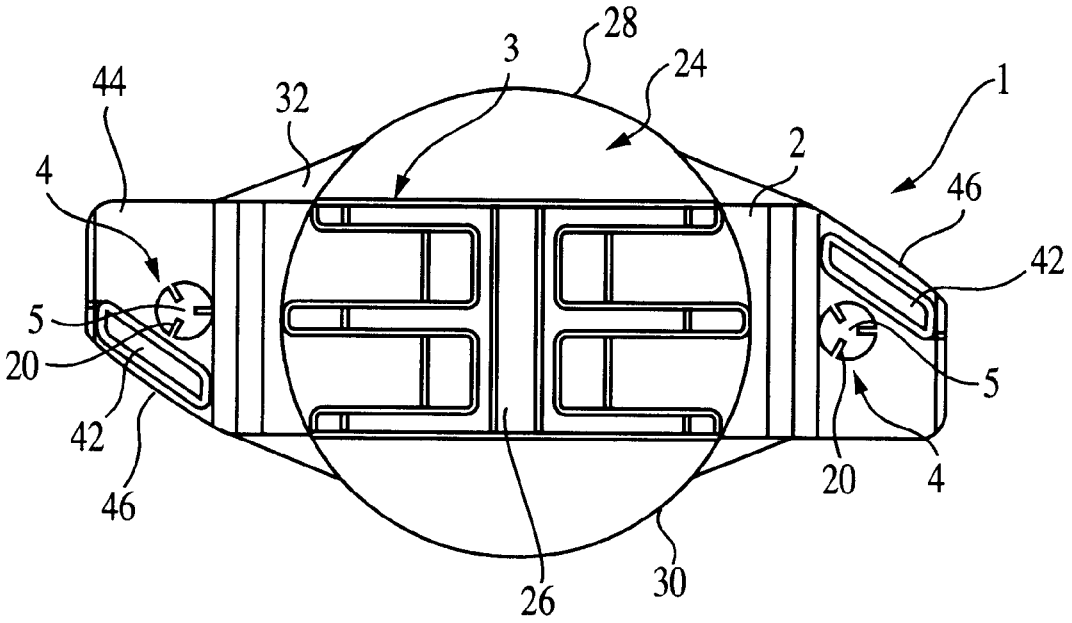

With respect to FIG. 2 there is illustrated in FIGS. 1*a*) and 1*b*) a side and plan view respectively of another embodiment of the present invention. For ease of reference like reference numbers to those used in FIG. 1 illustrate like elements in FIG. 2.

In FIG. 2 the retaining-portions 4 have projections 20 which deform to hold a nail to the insulator 1.

Referring now to FIGS. 1 and 2, the insulator 1 further includes a flap mount-abutting face 22 for abutment with the mount (not shown) and a fixture 24 which includes the electric fence wire support 3 for supporting the conducting material. The fixture 24 includes a conductor-receiving opening 26 offset from the mount-abutting face 22, a circular section 28 of the fixture being positioned between the conductor-receiving opening 26 and the mount-abutting face 22. The circular section 28 has a circular peripheral edge 30 aligned substantially parallel to the mount-abutting face 22.

At least one of the openings 5 is configured for receiving a fixing element or fastener 7 such as a nail to fix the insulator 1 to the mount, each opening extends between the mount-abutting face 22 and an outer surface 32 of the insulator, each opening has a longitudinal axis.

A plurality of the flaps 6 (best seen in FIG. 1) are formed integrally with the insulator 1, the flaps project radially into each opening 5 to substantially close are end 34 of the opening at or adjacent the outer surface 32. The flaps 6 are in the form of resilient cantilevered beam-like elements. Each flap 6 is sector-shaped with substantially flat inner and outer faces 36, 38 that are joined by two radially extending edges 40 (seen in FIG. 1*b*). Tile inner face 36 of each flap 6 lies in a substantially radially extending plane. The outer face 36 of each flap is substantially coplanar with a section of the outer surface 32 surrounding the fastener opening 5.

As seen in FIG. 1*c*, the flaps 6 are adapted to be deflected axially upon engagement with the fastener 7 to resiliently engage with and retain the fastener prior to the insulator being fixed to the mount with the fastener.

Adjacent to each fastener opening 5, the outer surface 32 of the insulator 1 includes an elongate ridge 42 protruding above a generally planar section 44 contiguous with the ridge. Each ridge 42 extends parallel to a respective generally straight edge portion 46 of the insulator 1, and each ridge 42 is positioned between the respective edge portion 46 and one of the fastener openings 5.

In the preferred embodiment, there are two fastener openings 5, each on opposing sides of the fixture 1, wherein the longitudinal axes of the fastener openings are substantially coplanar with a central axis of the fixture, the central axis extending perpendicular to the mount-abutting face 22 through the center of the circular section 28. The central axis and the longitudinal axes of the fastener openings S lie in a central plane of the insulator 1, and the line of each edge portion 46 intersects obliquely with the central plane.

Aspects of the present invention have been described by way of example only and it should be appreciated that modifications and additions may be made thereto without departing from the scope of the appended claims.

What is claimed is:

1. An insulator for supporting a conductor of an electric fence upon a mount, said insulator comprising:

a flat mount-abutting face for abutment with the mount;

a fixture for supporting the conductor, the fixture including circular section and a conductor-receiving opening offset from the mount-abutting face, the circular section positioned between the conductor-receiving opening and the mount-abutting face the circular section having a circular peripheral edge aligned substantially parallel to the mount-abutting face;

at least one fastener opening for receiving a fastener to fix the insulator to the mount, each said fastener opening extending between said mount-abutting face and an outer surface of the insulator, each said fastener opening having a longitudinal axis;

flaps formed integrally with the insulator, the flaps projecting radially into each said fastener opening to substantially close an end of said fastener opening at or adjacent said outer surface;

the flaps being in the form of resilient cantilevered beam-like elements;

each flap being sector-shaped with substantially flat inner and outer faces that are joined by two radially extending edges;

the flaps are adapted to be deflected axially upon engagement with the fastener to resiliently engage with and retain the fastener prior to the insulator being fixed to the mount with the fastener.

2. The insulator of claim 1 wherein adjacent to each fastener opening said outer surface of the insulator includes an elongate ridge protruding above a planar section contiguous with the ridge, each ridge extending parallel to a respective generally straight edge portion of the insulator, each ridge being positioned between said respective edge portion and one said fastener opening.

3. The insulator of claim 2 having two fastener openings, each on opposing sides of the fixture, wherein the longitudinal axes of the fastener openings are substantially coplanar with a central axis of the fixture, the central axis extending perpendicular to said mount-abutting face through the center of said circular section.

4. The insulator of claim 3 wherein said central axis and said longitudinal axis lie in a central plane of the insulator and wherein the line of each said edge portion intersects obliquely with said central plane.

5. The insulator of claim 4 wherein said outer face of each flap is substantially coplanar with a section of said outer surface surrounding the fastener opening.

6. The insulator of claim 5 wherein said inner face of each flap lies in a substantially radially extending plane.

7. A molded plastic one-piece electric fence insulator for supporting electric fence wire upon a fence post, said insulator comprising:

a flat mount-abutting face for abutment with the post;

a fixture for supporting the electric fence wire, the fixture including a circular section and a conductor-receiving opening offset from the mount-abutting face, the circular section positioned between the conductor-receiving opening and the mount-abutting face the circular section having a circular peripheral edge aligned substantially parallel to the mount-abutting face;

two fastener openings for receiving respective fasteners for fixing the insulator to the mount, the fastener openings being positioned on opposing sides of the fixture, the fastener openings extending between said mount-abutting face and an outer surface of the insulator, the fastener openings having respective longitudinal axes;

flaps formed integrally with the insulator, the flaps projecting radially into each said fastener opening to substantially close an end of each fastener opening at or adjacent said outer surface;

the flaps being in the form of resilient cantilevered beam-like elements;

each flap being sector-shaped with substantially flat inner and outer faces that are joined by two radially extending edges;

the flaps are configured to be deflected axially upon engagement with respective fastener to resiliently engage with and retain the fastener prior to the insulator being fixed to the mount with the fastener; and adjacent to each said fastener opening said outer surface of the insulator includes an elongate ridge protruding above a planar section contiguous with respective ridge each ridge extending parallel to a respective generally straight edge portion of the insulator, each ridge being positioned between said respective edge portion and one said fastener opening.

* * * * *

UNITED STATES PATENT AND TRADEMARK OFFICE

CERTIFICATE OF CORRECTION

PATENT NO. : 6,489,569 B1
DATED : December 3, 2002
INVENTOR(S) : Bradley John Thomson It is certified that error appears in the above-identified patent and that said Letters Patent is hereby corrected as shown below:

Column 3,
Line 36, between the words “opening” and “extends”, insert the number -- 5 --.
Line 41, after the phrase “substantially close”, delete “are” and insert -- an -- therefor.

Column 4,
Line 1, delete “S” and insert the number -- 5 -- therefor.

Column 5,
Line 7, delete “mount” and insert -- post -- therefor.

Signed and Sealed this

Twenty-second Day of July, 2003

JAMES E. ROGAN
*Director of the United States Patent and Trademark Office*